US007814823B2

(12) United States Patent
Takahashi et al.

(10) Patent No.: US 7,814,823 B2
(45) Date of Patent: Oct. 19, 2010

(54) FEEDBACK LINK FOR SWASH PLATE-TYPE VARIABLE DISPLACEMENT HYDRAULIC ROTARY MACHINE

(75) Inventors: Masakazu Takahashi, Kasumigaura (JP); Kazumasa Yuasa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 571 days.

(21) Appl. No.: 11/632,422

(22) PCT Filed: Apr. 14, 2006

(86) PCT No.: PCT/JP2006/308367

§ 371 (c)(1),
(2), (4) Date: Jan. 12, 2007

(87) PCT Pub. No.: WO2006/129431

PCT Pub. Date: Dec. 7, 2006

(65) Prior Publication Data

US 2008/0041223 A1 Feb. 21, 2008

(30) Foreign Application Priority Data

May 30, 2005 (JP) ..... 2005-157687

(51) Int. Cl.
*F01B 3/00* (2006.01)
*F01B 13/04* (2006.01)
*F01B 9/02* (2006.01)
*F04B 1/06* (2006.01)

(52) U.S. Cl. ..... 91/505; 417/222.1; 417/269; 92/13

(58) Field of Classification Search ..... 91/505; 267/159, 158; 411/352, 360, 513, 514, 522; 417/222.1, 269; 92/13; 292/19
See application file for complete search history.

(56) References Cited

U.S. PATENT DOCUMENTS 1,572,346 A * 2/1926 Adsit ..... 217/57

(Continued)

FOREIGN PATENT DOCUMENTS

JP 62-12273 3/1987

(Continued)

OTHER PUBLICATIONS

Machine Translation of JP 2003074461.*

(Continued)

*Primary Examiner*—Devon C Kramer
*Assistant Examiner*—Nathan Zollinger
(74) *Attorney, Agent, or Firm*—Mattingly & Malur, P.C.

(57) ABSTRACT

A feedback link which transmits a movement of a servo piston to a control sleeve of a regulator is constituted by a link lever formed of a rigid material and an expansion spring formed of a spring material. The expansion spring is formed by folding a narrow leaf spring substantially into U-shape, and provided with a pair of convexly curved plate portions extending forward from a bent portion as a base end and spread apart from each other in a forward direction. On the other hand, an indented groove which is provided on the servo piston is composed of a parallel groove portion and a tapered groove portion. The convexly curved plate portions are engaged in the parallel groove portion of the indented groove in a resilient deformed state to transmit a displacement of the servo piston from the expansion spring to the link lever.

4 Claims, 9 Drawing Sheets

U.S. PATENT DOCUMENTS

| | | | | |
|---|---|---|---|---|
| 4,970,762 | A * | 11/1990 | Oreck et al. | 24/625 |
| 5,927,176 | A * | 7/1999 | Stolzer | 92/12.2 |
| 6,413,055 | B1 * | 7/2002 | Geringer et al. | 417/222.1 |
| 2007/0131106 | A1 * | 6/2007 | Wustefeld | 91/506 |

FOREIGN PATENT DOCUMENTS

| | | | |
|---|---|---|---|
| JP | 6-193554 | | 7/1994 |
| JP | 2003-74460 | | 3/2003 |
| JP | 2003-74461 | | 3/2003 |
| JP | 2003074460 | A * | 3/2003 |
| JP | 2003074461 | A * | 3/2003 |
| JP | 2003-269324 | | 9/2003 |
| JP | 2004-278413 | | 10/2004 |
| JP | 2004278413 | A * | 10/2004 |

OTHER PUBLICATIONS

Machine Translation of JP2003074461A.*

* cited by examiner

FEEDBACK LINK FOR SWASH PLATE-TYPE VARIABLE DISPLACEMENT HYDRAULIC ROTARY MACHINE

TECHNICAL FIELD

This invention relates to a swash plate type variable, displacement hydraulic rotary machine to be mounted on a construction machine, for example, on a hydraulic excavator to serve as a swash plate type variable displacement hydraulic pump or motor.

BACKGROUND ART

Generally, a swash plate type variable displacement hydraulic rotary machine which is provided on a construction machine like a hydraulic excavator is used as a variable displacement hydraulic pump which constitutes a hydraulic pressure source along with a tank, or as a variable displacement hydraulic motor which constitutes a hydraulic actuator for driving a vehicle or for revolving a working mechanism of the machine.

According to prior art, for example, a swash plate type variable displacement hydraulic rotary machine is composed of a swash plate which is tiltably provided within a casing to serve as a variable displacement member, a tilting actuator provided within the casing and equipped with a servo piston for driving the swash plate into a tilted position according to a tilting control pressure which is supplied from outside, a regulator in the form of a servo valve provided within the casing and having a spool within a control sleeve for variably controlling the tilting control pressure to the tilting actuator, and a feedback link provided between the control sleeve of the regulator and the servo piston to transmit a displacement of the servo piston to said control sleeve (e.g., Japanese Patent Laid-Open No. 2003-74460).

In this instance, the above-mentioned feedback link is in the form of a bifurcated holder spring with a function of attenuating high frequency vibrations. This holder spring is arranged to hold a pin member on the servo piston radially from opposite sides, for picking up and transmitting a displacement of the servo piston to the outside (to the control sleeve of the regulator).

In the case of the prior art mentioned above, the feedback link is constituted by a bifurcated holder spring. Therefore, in this case there is an advantage that, in the event the swash plate is put in repeated high frequency vibrations under the influence of pulsations in hydraulic pressure, high frequency vibrations can be attenuated by the holder spring portion of the feedback link as high frequency vibrations are transmitted to the servo piston from the swash plate.

The holder spring of the above-mentioned prior art is constituted by a pair of (a couple of) holder portions which are adapted to hold a pin member on the servo piston radially from opposite sides, to pick up and transmit an axial displacement of the servo piston to the outside through the two holder portions. However, the holder spring by the prior art suffers from problems as discussed below.

More specifically, the tilting actuator drives the swash plate into a tilted position by displacing the servo piston in the axial direction. Therefore, at the time of changing the tilt angle of the swash plate, each time the servo piston is displaced axially in a forward or reverse direction.

However, as the direction of axial displacement of the servo piston is reversed, one of the two holder portions which are provided on the holder spring, more specifically, one holder portion which is located in a rear side in the direction of displacement of the servo piston is slightly moved away from the surface of the pin member even if the other holder portion (which is located in a front side in the direction of displacement) is held in abutting engagement with the pin member. This gives rise to a problem that a rattling movement takes place between the pin member and a pair of holder portions each time the direction of displacement of the servo piston is reversed.

When the control of the tilt angle of the swash plate (displacement control) is repeated during use over an extended period of time, impact load attributable to the rattling movement is repeatedly applied to the holder spring to cause plastic deformation of the latter. If the holder spring undergoes deformations repeatedly in this manner, it becomes difficult for the holder spring (for the feedback link) to pick up and transmit displacements of the servo piston to the outside in a stable state.

DISCLOSURE OF THE INVENTION

In view of the above-discussed problems with the prior art, it is an object of the present invention to provide a swash plate type variable displacement hydraulic rotary machine, which permits a feedback link to pick up displacements of the servo piston in a stabilized state over a long period of time, while precluding possibilities of rattling movements and plastic deformations.

(1) In order to achieve the above-stated objective, the present invention is applied to a swash plate type variable displacement hydraulic rotary machine, which includes a tubular casing, a rotational shaft rotatably supported within the casing, a cylinder block mounted on the rotational shaft within the casing and bored with a plural number of axially extending cylinders at radially spaced positions, a plural number of pistons reciprocally fitted in the cylinders of the cylinder block and each having a shoe at an projected end, a swash plate tiltably provided in the casing and provided with a sliding surface for sliding engagement with the shoe, a tilting actuator provided with a servo piston in the casing to drive the swash plate into a tilted position according to a supplied tilting control pressure, a regulator in the form of a servo valve provided in the casing and having a spool within a control sleeve to variably control a tilting control pressure to the tilting actuator, and a feedback link provided between the control sleeve of the regulator and the servo piston of the tilting actuator to transmit a displacement of the servo piston to the control sleeve.

The swash plate type variable displacement hydraulic rotary machine according to the present invention is characterized in that the feedback link is constituted by a link lever having one longitudinal end thereof connected to the control sleeve of the regulator, and an expansion spring being fixed to the other end of the link lever at a base end and adapted to spread apart from each other at fore distal ends by spring action; and in that the an indented groove is provided on the outer peripheral side of the servo piston for abutting engagement with fore end portions of the expansion spring.

With the arrangements just described, when the direction of displacement of the servo piston is reversed, for example, fore ends of the expansion spring can be constantly kept in abutting engagement against side walls of the indented groove, precluding rattling movements which would otherwise occur therebetween. Even in case the swash plate is put in repeated high frequency vibrations under the influence of pulsations in hydraulic pressure, high frequency vibrations transmitted from the servo piston (the tilting actuator) are attenuated by the expansion spring before reaching the link lever, preventing the link lever from being put in repeated minute vibrations to ensure higher durability and prolonged service life of the link lever.

Therefore, even if the control of tilt angle (the control of displacement volume) of the swash plate is repeated over a long period of time, it becomes possible to suppress rattling movements which would otherwise occur between fore end portions of the expansion spring and the indented groove on the servo piston, preventing plastic deformations of fore end portions of the expansion spring. Accordingly, the above arrangements permits the feedback link to pick up displacements of the servo piston in a stabilized state over a long period of time, stabilizing the control of displacement volume of the hydraulic rotary machine to enhance reliability in operation.

(2) Further, according to the present invention, the expansion spring is formed by folding a narrow leaf spring substantially into U-shape.

In this case, a base end portion of the expansion spring can be fixed to the link lever, while on the front side of the expansion spring is bifurcated into a pair of expansion portion which are spread away from each other in a forward direction. The bifurcated expansion portion of the expansion spring is resiliently abutted against opposite side walls of the indented groove on the servo piston, preventing rattling movements from occurring between these parts.

(3) Further, according to the present invention, a pair of convexly curved plate portions are provided on fore end portions of the expansion spring, the convexly curved plate portions having arcuate faces resiliently abutted against side walls of the indented groove.

In this case, a pair of convexly curved plate portions are formed on fore end portions of the expansion spring, and arcuate faces of the convexly curved plate portions are resiliently abutted against opposite side walls of the indented groove on the servo piston, thereby preventing rattling movements from occurring between these parts. Besides, the convexly curved plate portions are abutted against side walls of the indented groove smoothly through arcuate faces, permitting the feedback link to pick up displacements of the servo piston in a stabilized state.

(4) On the other hand, according to the present invention, the indented groove on the servo piston is composed of a parallel groove portion extending transversely of the servo piston, and a tapered groove portion connected to and spread in a tapered fashion in a direction away from the parallel groove portion for guiding fore end portions of the expansion spring into the parallel groove portion.

In this case, by the tapered groove portion, fore ends (the bifurcated expansion arms) of the expansion spring can be guided toward the parallel groove portion, and fore ends of the expansion spring can be engaged in the indented groove (the parallel groove portion) on the servo piston stably in a resiliently deformed state.

BEST MODE FOR CARRYING OUT THE INVENTION

Hereafter, the swash plate type variable displacement hydraulic rotary machine according to the present invention is described more particularly by way of its preferred embodiments shown in the accompanying drawings, which are applied by way of example to a swash plate type variable displacement hydraulic pump.

Shown in FIGS. 1 through 9 is a first embodiment of the present invention. In these figures, indicated at 1 is a swash plate type variable displacement hydraulic pump (hereinafter referred to simply as "a hydraulic pump 1" for brevity), adopted as a first embodiment of the present invention. Indicated at 2 is a casing which is arranged to form an outer shell of the hydraulic pump 1, and which is constituted by a main casing body 3 of a stepped cylindrical shape having a front bottom portion 3A at one end thereof, and a rear casing 4 which is arranged to close the other end of the main casing body 3.

Figure 2:
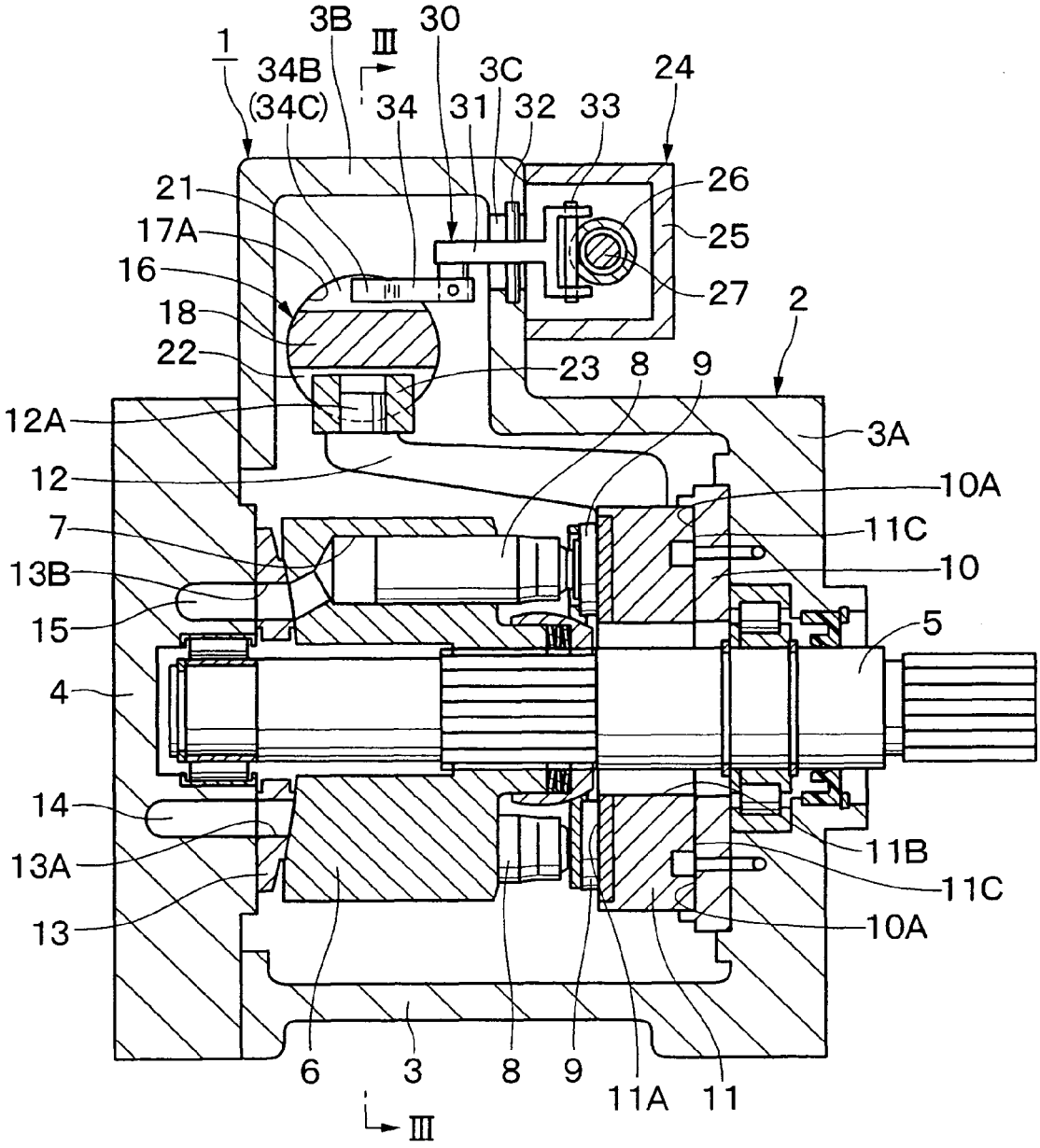
FIG. 2 is a vertical section of a cylinder block, tilting actuator, regulator and feedback link of the hydraulic pump, taken from the direction of arrows II-II in FIG. 1.
Figure 3:
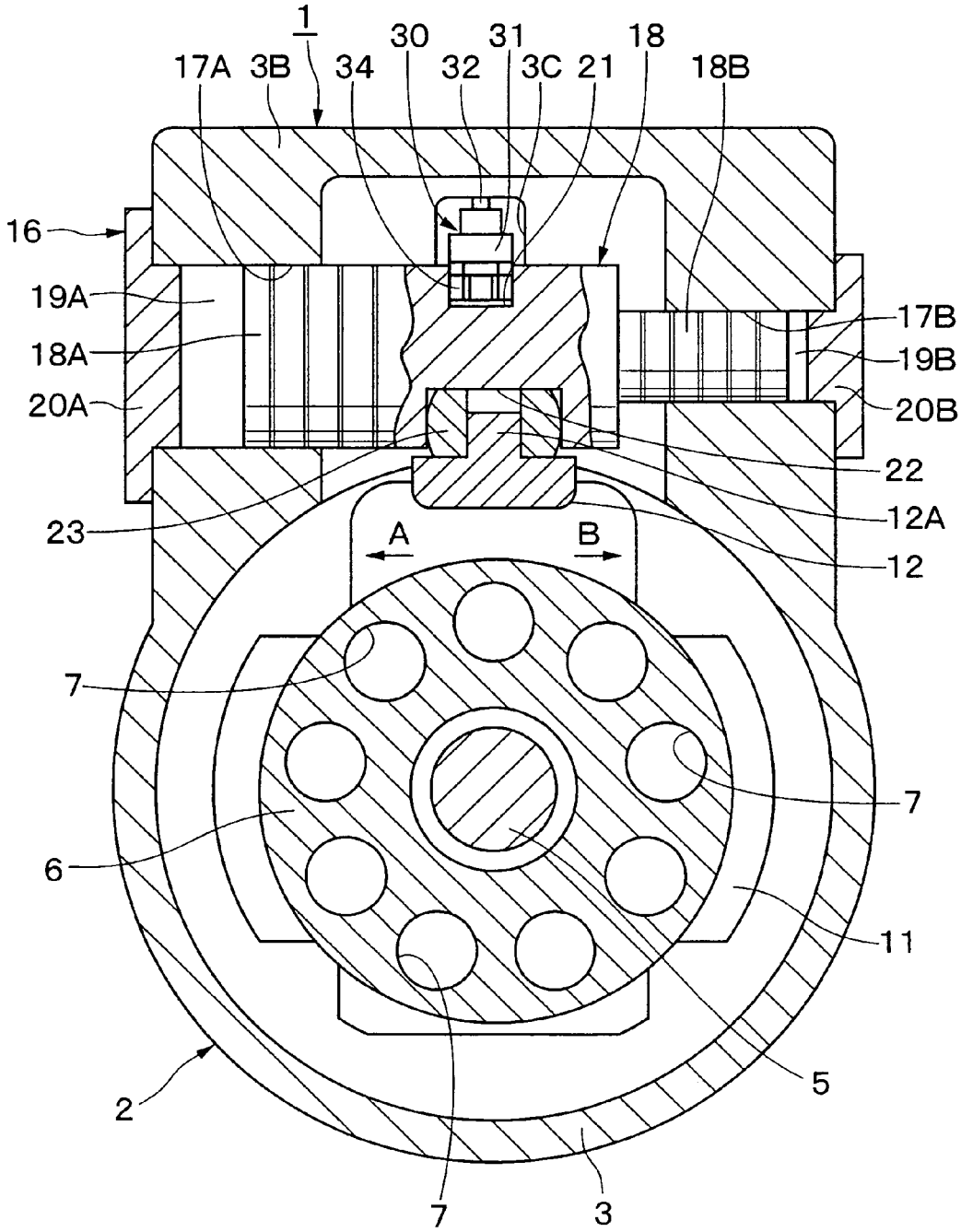
FIG. 3 is a sectional view of the cylinder block, tilting actuator and feedback link of the hydraulic pump, taken from the direction of arrows III-III in FIG. 2.

Further, as shown in FIG. 2, an actuator mount portion 3B is provided within the main casing body 3 of the casing 2, at an axially spaced position relative to the front bottom portion 3A. This actuator mount portion 3B is projected radially outward of the main casing body 3. As shown in FIGS. 2 and 3, accommodated in the actuator mount portion 3B is a tilting actuator 16 which will be described hereinafter.

Further, formed in the actuator mount portion 3B of the main casing body 3 on the side of the regulator 24, which will be described hereinafter, is a slot 3C which is substantially in a square shape as shown in FIGS. 2 and 3. A link lever 31 of the feedback link 30, which will be described hereinafter, is pivotally received in the slot 3C by the use of a pivoting pin 32.

On the other hand, formed in the rear casing 4 of the casing 2 are supply/discharge passages 14 and 15, which will be described hereinafter. Through these supply/discharge passages 14 and 15, operating oil (pressure oil) is supplied to and from the cylinder 7 through a valve plate 13 which will be described later on.

Indicated at 5 is a rotational shaft which is rotatably mounted within the casing 2. One end of this rotational shaft 5 is rotatably supported in the front bottom portion 3A of the main casing body 3 through a bearing or the like, while the other end is rotatably supported in the rear casing 4 through a bearing or the like. To an end portion of the rotational shaft 5 (a projected end) which is axially projected out of the front bottom portion 3A of the main casing body 3, for example, a prime mover of a hydraulic excavator is connected through a power transmission mechanism (not shown) to drive the rotational shaft 5.

Denoted at 6 is a cylinder block which is mounted around the outer periphery of the rotational shaft 5 within the casing 2. This cylinder block 6 is provided with a plural number of axially extending cylinders 7 (normally an odd number of cylinders) at radially spaced positions. The cylinder block 6 is splined on the outer periphery of the rotational shaft 5 and rotationally driven together with the rotational shaft 5.

Indicated at 8 are a plural number of pistons which are slidably fitted in the respective cylinders 7 of the cylinder block 6. As the cylinder block 6 is put in rotation, the pistons 8 are reciprocated within the respective cylinders 7. At this time, the piston 8 take low-pressure operating oil into the cylinders 7 and deliver high-pressure oil.

Figure 1:
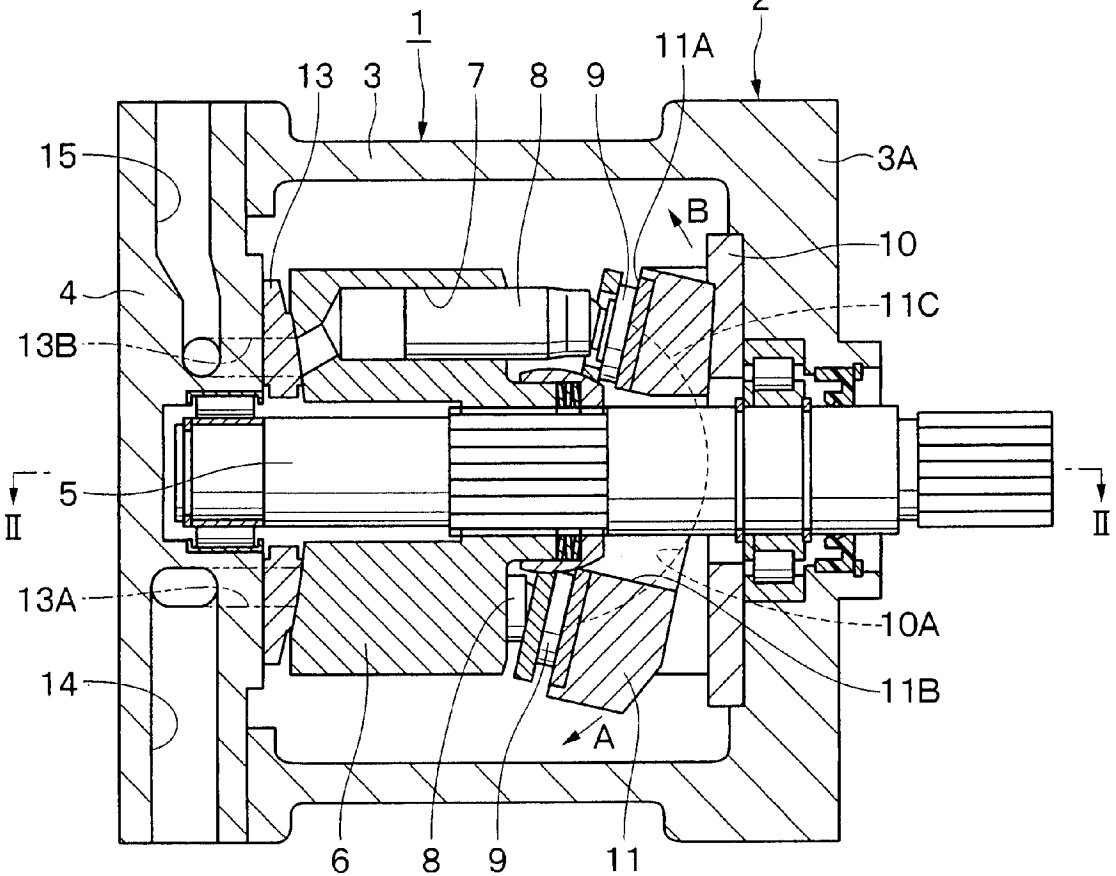
FIG. 1 is a vertical section of a swash plate type variable displacement hydraulic pump adopted as a first embodiment of the present invention.

In this instance, as shown in FIG. 1, each piston 8 is largely projected (extended) out of a cylinder 7 at a bottom dead center position on the upper side of the rotational shaft 5, and contracted into the cylinder 7 at a top dead center position on the lower side of the rotational shaft 5. On each revolution of the cylinder block 6, each piston 8 is repeatedly put in an intake phase while sliding from top to bottom dead center position and in a discharge phase while sliding from bottom to top dead center position in the cylinder 7.

In an intake phase of the pistons 8 which corresponds to a half revolution of the cylinder block 6, operating oil is sucked into the cylinders 7 through a low-pressure supply/discharge passage 14 which will be described hereinafter. In a discharge phase of the pistons 8 which corresponds to the other half revolution of the cylinder block 6, the operating oil within the cylinders 7 is pressurized by the pistons 8 to deliver high-pressure oil from a supply/discharge passage 15 to a discharge conduit 44 (see FIG. 9) which will be described later on.

Indicated at 9 are a plural number of shoes which are slidably provided at the projected ends of the pistons 8. By pressing force of the piston 8 (oil pressure), each one of these shoes 9 is pushed against a smooth surface 11A of the swash plate 11 which will be described hereinafter. As the shoes 9 are put in rotation in this state together with the rotational shaft 5, cylinder block 6 and piston 8, they are put in sliding movement in such a way as to draw a ring-like locus on the smooth surface 11A.

Indicated at 10 is a swash plate support block which is provided on the front bottom portion 3A of the main casing body 3. As shown in FIGS. 1 and 2, this swash plate support block 10 is located around the rotational shaft 5 and on the rear side of the swash plate 11, and fixed to the front bottom portion 3A of the main casing body 3. A pair of tilting slide surfaces 10A of a concavely curved shape are formed on the swash plate support block 10 thereby to tiltably support the swash plate 11. As shown in FIG. 2, these tilting slide surfaces 10A are provided in spaced positions on the right and left sides (or on the upper and lower sides) of the rotational shaft 5.

Designated at 11 is the swash plate which is tiltably provided within the casing 2. This swash plate 11 is mounted on the side of the front bottom portion 3A of the main casing body 3 through the swash plate support block 10, and provided with the smooth surface 11A on the front side for sliding contact with the shoes as described above. Further, an axial hole 11B is bored in the center portion of the swash plate 11 to receive the rotational shaft 5 loosely in gapped relation. Furthermore, a pair of legs 11C are provided on the rear side of the swash plate 11 in sliding contact with the tilting slide surface 10A of the swash plate support block 10.

In this instance, a pair of legs 11C, provided on the rear side of the swash plate 11, are tiltably abutted against the tilting slide surface 10A of the swash plate support block 10. By a tilting actuator 16 which will be described hereinafter, the swash plate 11 is tilted in the directions of arrows A and B indicated in FIGS. 1, 3 and 4. Through the tilting movements in the directions of arrows A and B, the swash plate 11 constitutes a variable displacement portion which variably controls the displacement capacity of the pump.

Figure 4:
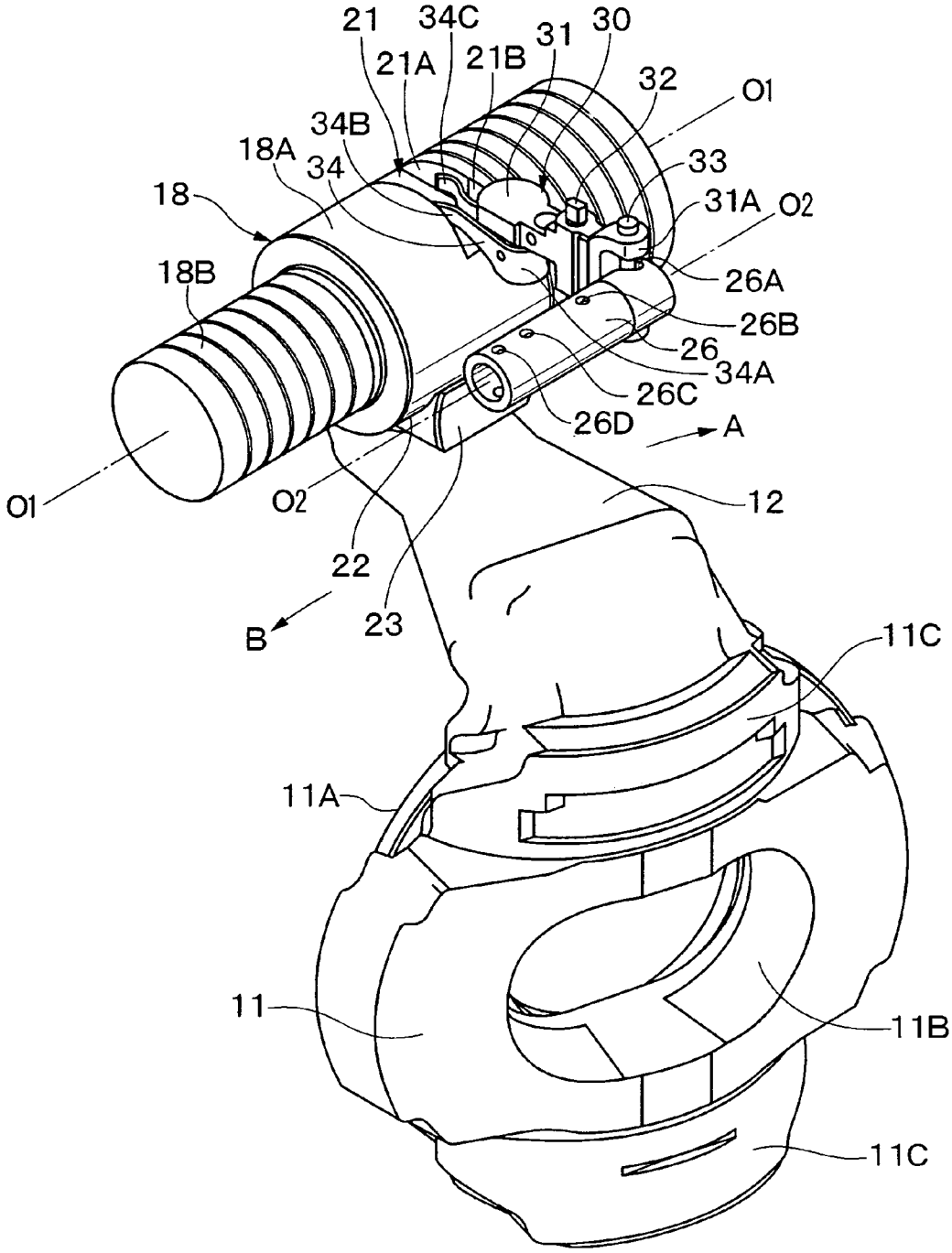
FIG. 4 is a perspective view of swash plate, tilting lever, servo piston, feedback link and control sleeve shown in FIG. 2.

Indicated at 12 is a tilting lever which is integrally formed at a lateral side portion of the swash plate 11. As shown in FIGS. 2 to 4, this tilting lever 12 is extended out from the lateral side of the swash plate 11 toward a servo piston 18 which will be described hereinafter. A projection pin 12A which is integrally provided at the fore distal end of the tilting lever 12 is connected to a servo piston 18, which will be described hereinafter, through a slide plate 23.

Denoted at 13 is a valve plate which is fixedly provided in the rear casing 4. This valve plate 13 is constitutes a change-over valve plate in sliding contact with an end face of the cylinder block 6. For this purpose, as shown in FIG. 2, the valve plate 13 is provided with a pair of supply/discharge ports 13A and 13B of an eyebrow shape which are extended around the rotational shaft 5. Of these supply/discharge ports 13A and 13B, for example, the supply/discharge port 13A constitutes an inlet or supply port on the low-pressure side while the supply/discharge port 13B constitutes an outlet or discharge port on the high pressure side.

Indicated at 14 and 15 are a pair of supply/discharge passages which are formed in the rear casing 4 for sucking in and discharging operating oil. Of these supply/discharge passages 14 and 15, the supply/discharge passage 14 on the low-pressure side is communicated with the supply/discharge port 13A of the valve plate 13, and, for example, connected to the side of a tank 37 of FIG. 9 which will be described hereinafter. The supply/discharge passage 15 on the high-pressure side is communicated with the supply/discharge port 13B of the valve plate 13, and connected to a discharge conduit 44 of FIG. 9 which will be described hereinafter.

As the rotational shaft 5 is driven and put in rotation within the casing 2, the pistons 8 are reciprocated within the respective cylinders 7 in step with rotation of the cylinder block 6. In an intake phase, the pistons 8 suck in operating oil into the cylinders 7 from the side of the supply/discharge passage 14, and, in a delivery phase, discharge pressure oil to the side of the supply/discharge passage 15.

Denoted at 16 is a tilting actuator which is provided in an actuator mount portion 3B in the main casing body 3. As shown in FIGS. 2 and 3, this tilting actuator 16 is largely constituted by cylinder bores 17A and 17B which are formed as tilting control cylinders in an actuator mount portion 3B of the main casing body 3 radially on the outer side of the cylinder block 6, and a servo piston 18 which is slidably fitted in the cylinder bores 17A and 17B. By the servo piston 18 of the tilting actuator 16, the swash plate 11 is driven into a tilted position either in the direction of arrow A or B.

Indicated at 18 is the servo piston which constitutes a movable part of the tilting actuator 16. As shown in FIG. 3, the servo piston 18 is in the form of a stepped piston having a large diameter portion 18A and a small diameter portion 18B. The large diameter portion 18A of the servo piston 18 is slidably received in the cylinder bore 17A in the actuator mount portion 3B, while the small diameter portion 18B is slidably received in the cylinder bore 17B.

In this instance, as shown in FIG. 3, the large diameter portion 18A of the servo piston 18 defines a large-diameter pressure chamber 19A within the cylinder bore 17A, which is closed with a lid plate 20A from outer side of the cylinder bore 17A. On the other hand, the small diameter portion 18B of the servo piston 18 defines a small-diameter pressure chamber 19B within the cylinder bore 17B, which is closed with a lid plate 20B from outer side of the cylinder bore 17B.

As a tilting control pressure is supplied to or discharged from the pressure chambers 19A and 19B through control pressure conduits 39 and 40 (see FIG. 9) which will be described hereinafter, the servo piston 18 of the tilting actuator 16 is put in a sliding displacement in an axial direction of the cylinder bores 17A and 17B according to the supplied tilting control pressure. At this time, through the tilting lever 12, the axial displacement of the servo piston 18 is transmitted to the swash plate 11 from a slide plate 23 which will be described later on. As a consequence, the swash plate 11 is driven into a tilted position in the direction of arrow A or B following the movement of the servo piston 18.

Denoted at 21 is an indented groove which is formed into the large diameter portion 18A of the servo piston 18. As shown particularly in FIGS. 3 to 5, the indented groove 21 is in the form of a notched groove of U-shape in section, which is formed by notching part of an outer peripheral portion of the large diameter portion 18A. The indented groove 21 is located in a radially opposite position on the large diameter portion 18A relative to a coupling groove 22, which will be described hereinafter, across longitudinal axis O1-O1 of the servo piston 18.

Figure 6:
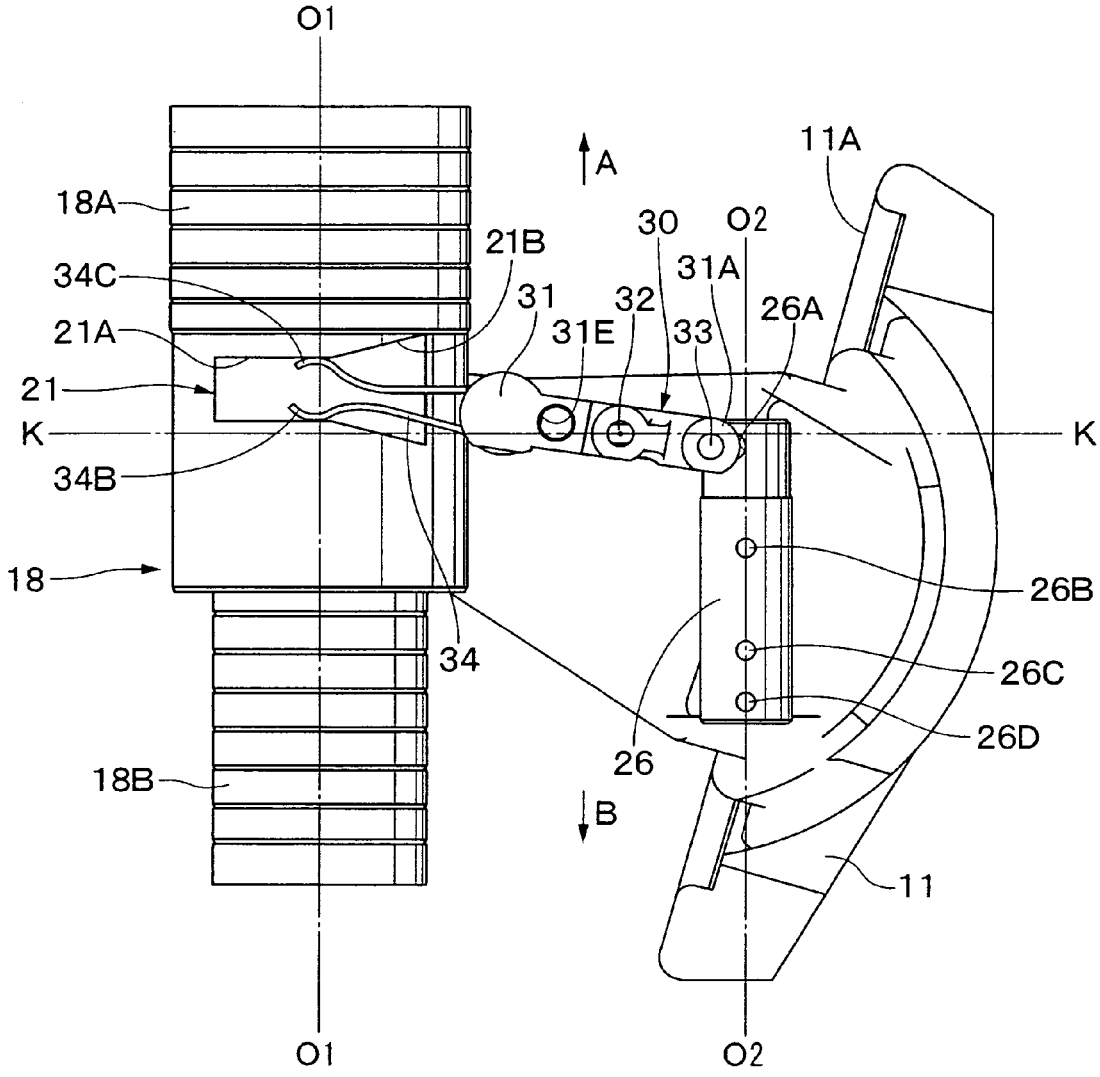
FIG. 6 is a plan view of the swash plate, tilting lever, servo piston, feedback link and control sleeve of FIG. 4, taken from the upper side.
Figure 7:
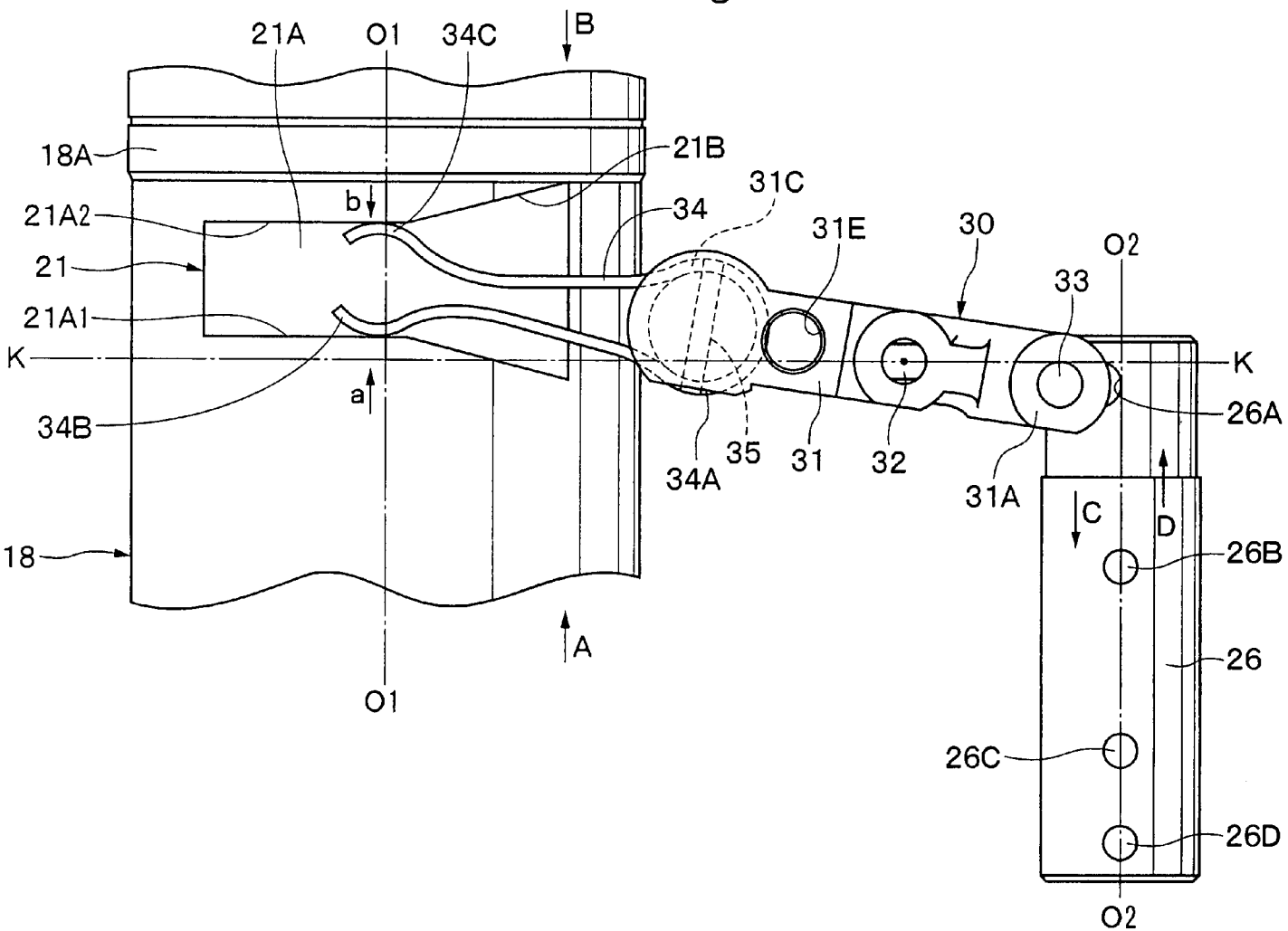
FIG. 7 is an enlarged fragmentary view of the servo piston, feedback link and control sleeve in FIG. 6.
Figure 8:
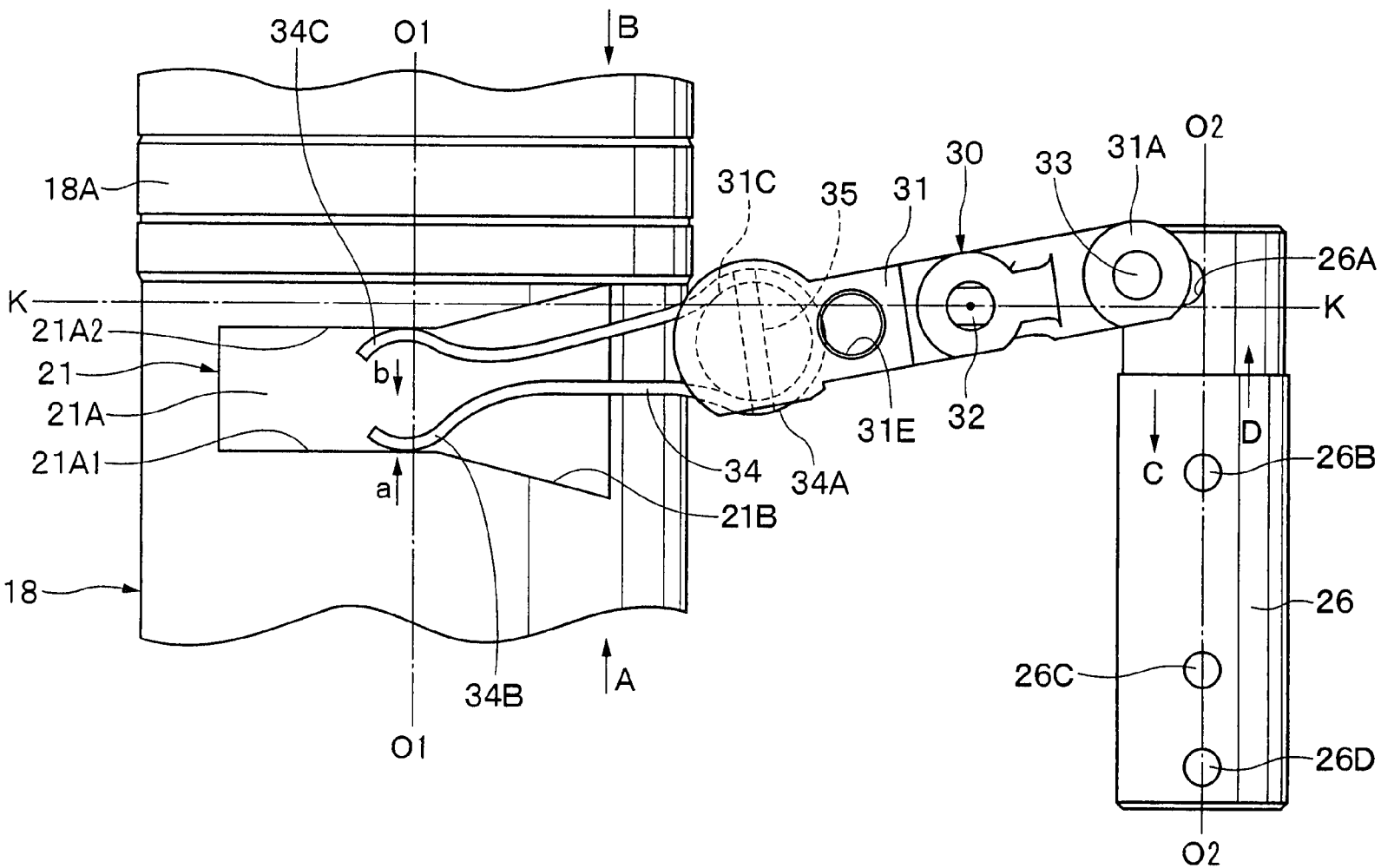
FIG. 8 is an enlarged fragmentary view taken from the same position as FIG. 7, showing the servo piston in an axially displaced position.

In this instance, as shown in FIGS. 6 to 8, the indented groove 21 is composed of a parallel groove portion 21A which is extended radially and perpendicularly relative to the longitudinal axis O1-O1 of the servo piston 18, and a tapered groove portion 21B which is diverged in a tapered fashion from a proximal end of the parallel groove portion 21A. At the opposite sides, the parallel groove portion 21A of the indented groove 21 defines side wall portions 21A1 and 21A2 which extend parallel with each other in a direction perpendicular to the longitudinal axis O1-O1 of the servo piston 18.

Further, as compared with the coupling groove 22, the parallel groove portion 21A of the indented groove 21 is smaller in width (a measure in the axial direction of the servo piston 18). In the parallel groove portion 21A, convexly curved plate portions 34B and 34C of an expansion spring 34, which will be described hereinafter, are engaged in a resiliently deformed state. Further, the side wall portions 21A1 and 21A2 which stand opposingly across the width of the parallel groove portion 21A are held in abutting engagement with the convexly curved plate portions 34B and 34C of the expansion spring 34 to transmit axial displacements of the servo piston 18 to the expansion spring 34.

On the other hand, for the purpose of guiding the convexly curved plate portions 34B and 34C of the expansion spring 34 smoothly toward the parallel groove portion 21A, the tapered groove portion 21B of the indented groove 21 is formed in a equilateral trapezoidal shape. The tapered groove portion 21B also has a function of preventing proximal portions of the expansion spring 34 (those portions other than the convexly curved plate portions 34B and 34C) from falling into contact or interference with side walls of the indented groove 21 when the servo piston 18 is displaced in an axial direction along the longitudinal axis O1-O1, as shown in FIGS. 7 and 8.

Figure 5:
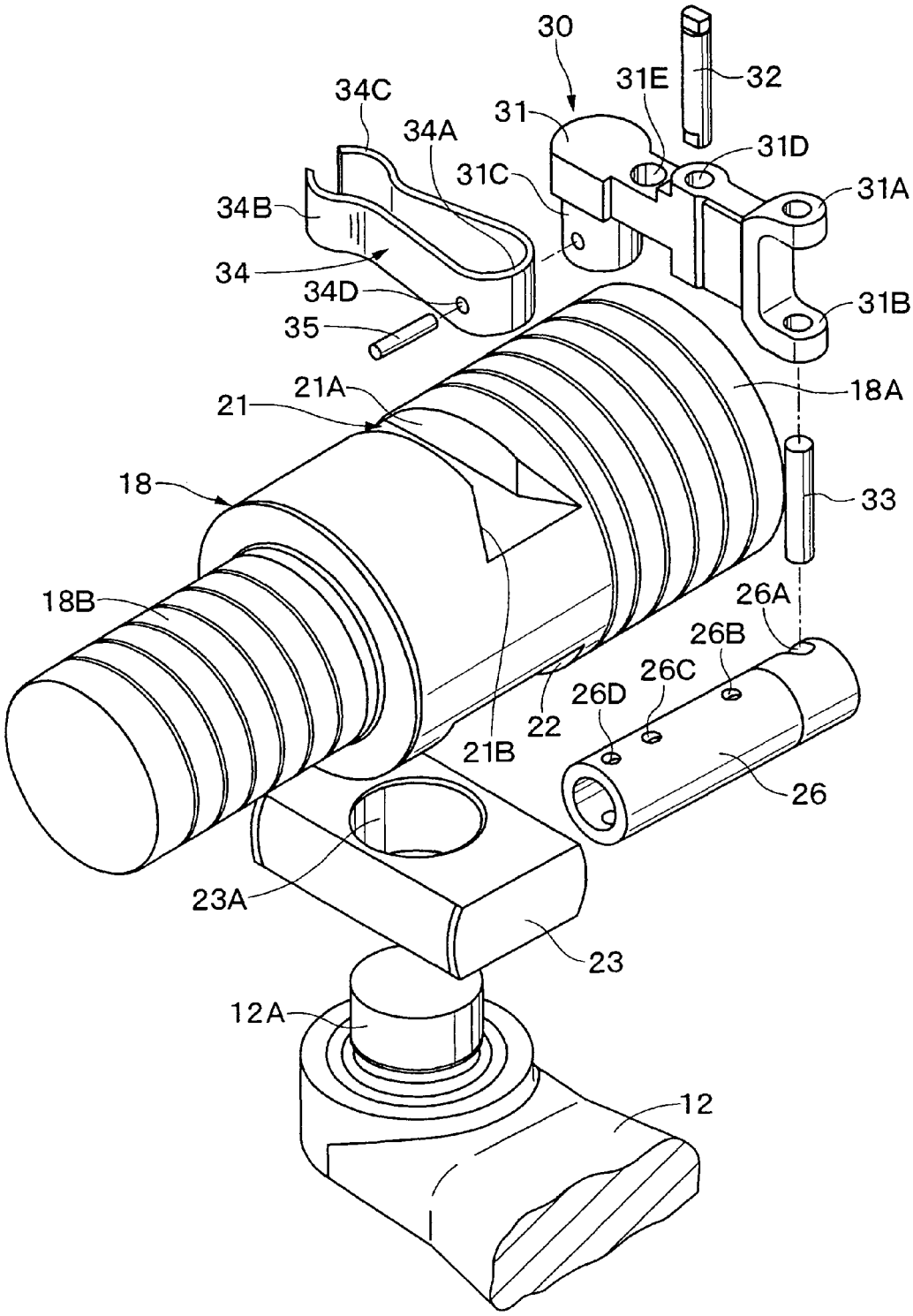
FIG. 5 is an exploded perspective view showing the tilting lever, servo piston, feedback link and control sleeve of FIG. 4 on an enlarged scale.

Indicated at 22 is the coupling groove which is provided on the large diameter portion 18A of the servo piston 18. As shown in FIGS. 3 to 5, the coupling groove 22 is in the form of a parallel groove of U-shape in section and located in a radially opposite position from the indented groove 21 across the longitudinal axis O1-O1. A slide plate 23, which will be described later on, is slidably mounted in the coupling groove 22 in order to transmit axial displacements of the servo piston 18 to the swash plate 11 through the tilting lever 12.

Indicated at 23 is the slide plate which is slidably fitted in the coupling groove 22 on the servo piston 18. As shown in FIG. 5, the slide plate 23 is constituted by a substantially rectangular plate which is slidable (capable of making a sliding displacement) in the coupling groove 22 in a direction transverse of the servo piston 18. The projection pin 12A of the tilting lever 12 is pivotally fitted in a fitting hole 23A which is bored at the center of the slide plate 23.

Namely, the projection pin 12A of the tilting lever 12 is fitted in the fitting hole 23A of the slide plate 23 before placing the latter in the coupling groove 22 on the servo piston 18. In this state, an axial displacement of the servo piston 18 is transmitted from the slide plate 23 to the swash plate 11 through the tilting lever 12, so that the swash plate 11 is driven into a tilted position in the direction of arrow A or B following the movement of the servo piston 18.

Denoted at 24 is a regulator which supplies and discharges a tilting control pressure to and from the tilting actuator 16. As shown in FIG. 2, this regulator 24 is provided with a valve case 25 which is detachably attached to a lateral side portion of the actuator mount portion 3B. The valve case 25 is so located as to cover from outside the slot 3C which is provided in the actuator mount portion 3B of the main casing body 3. A control sleeve 26 is slidably received in a sleeve slide hole (not shown) which is formed in the valve case 25 of the regulator 24, and a spool 27 is slidably fitted in the control sleeve 26.

Figure 9:
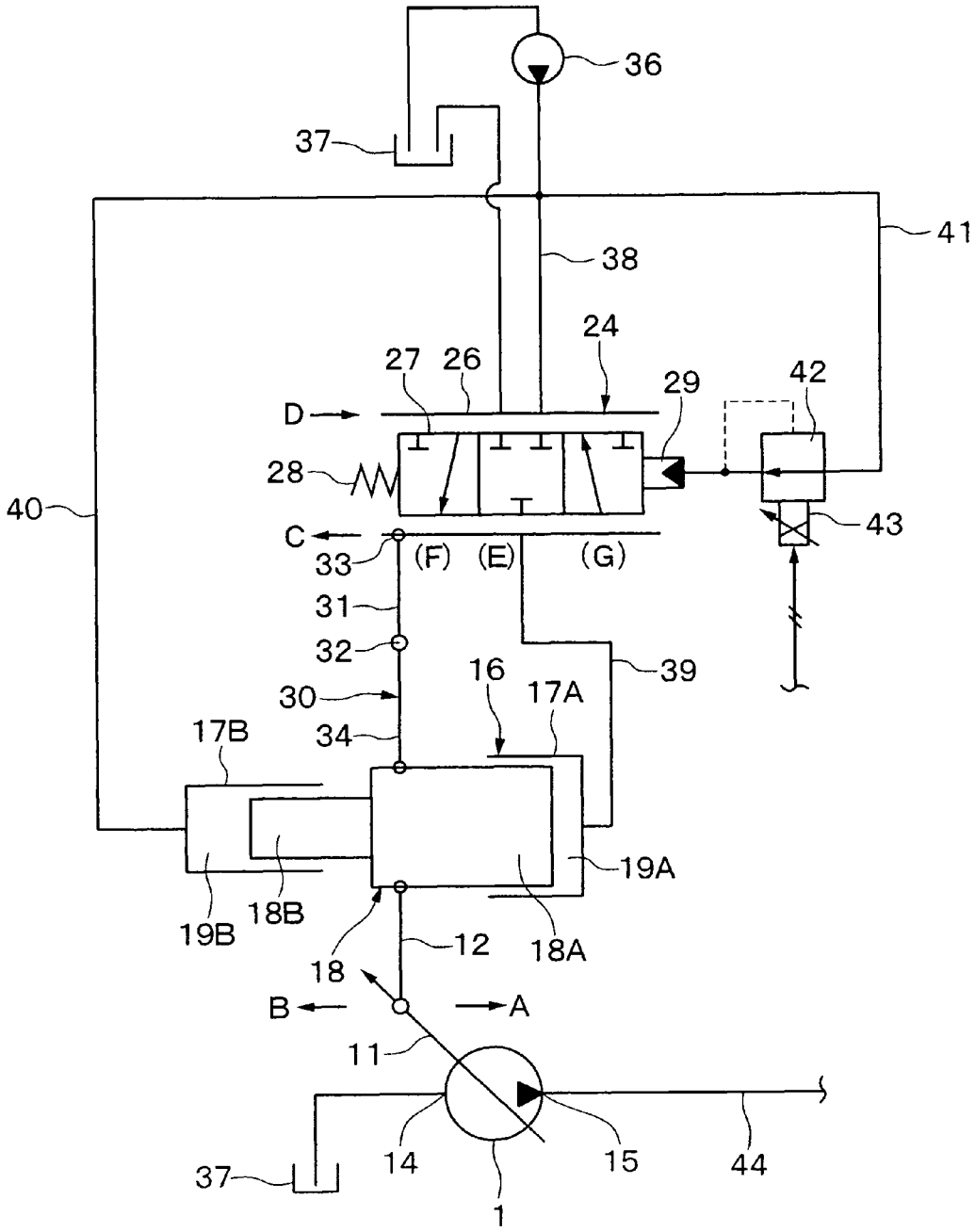
FIG. 9 is a diagram of a hydraulic circuit for the displacement control of the hydraulic pump shown in FIG. 1.

Namely, as shown in FIG. 9, the regulator 24 is arranged as a hydraulic servo valve having a spool 27 within the control sleeve 26. A valve spring 28 is provided at one end of the spool 27, while a hydraulic pilot portion 29 is provided at the other end of the spool 27. Through a pressure control valve 42, the hydraulic pilot portion 29 is connected to a pilot conduit 41 which will be described hereinafter.

In this instance, the control sleeve 26 is formed in a tubular shape having a longitudinal axis O2-O2 substantially parallel with the longitudinal axis O1-O1 of the servo piston 18. As shown in FIGS. 4 to 6, at one axial end, the control sleeve 26 is formed with an arcuate notched portion 26A on an outer peripheral surface for engagement with a coupling pin 33 which will be described hereinafter. Further, the control sleeve 26 is provided with three oil holes 26B, 26C and 26D which are bored radially at axially spaced positions between the notched portion 26A and the other axial end.

As shown in FIGS. 6 to 8, the control sleeve 26 is extended in the longitudinal direction of the axis O2-O2, and displaced in the axial direction (for feedback control) by a feedback link 30 which will be described hereinafter. As exemplified in FIG. 9, the oil holes 26B, 26C and 26D in the control sleeve 26 are connected to tank 37, and control pressure conduits 38 and 39 which will be described later on.

Denoted at 30 is the feedback link which is provided for feedback control of the regulator 24. As shown in FIGS. 2 to 6, this feedback link 30 is provided between the control sleeve 26 of the regulator 24 and the servo piston 18, constituting a feedback mechanism which feedback-controls the regulator 24 following tilting movements of the swash plate 11.

As shown in FIGS. 2 to 8, the feedback link 30 is constituted by a link lever 31, a pivoting pin 32 as a support pin, coupling pin 33 and expansion spring 34, which will be described hereinafter. Further, as shown in FIG. 2, the link lever 31 and expansion spring 34 are extended between the actuator mount portion 3B and the valve case 25 of the regulator 24 substantially in parallel relation with the tilting lever 12, and turned about the pivoting pin 32.

Indicated at 31 is the link lever which constitutes part of the feedback link 30. This link lever 31 is formed of steel or similar rigid material and in the shape of a stepped lever as shown in FIGS. 4 to 8. At one longitudinal end, the link lever 31 is integrally provided with a pair of pin support portions 31A and 31B which are extended obliquely, so to say, in a bifurcated form toward opposite end portions of a coupling pin 33 which will be described hereinafter (see FIG. 5). Further, the opposite end portions of the coupling pin 33 are fixed in the pin support portions 31A and 31B by press fit or other suitable means. Namely, the coupling pin 33 is fixedly supported by the pin support portions 31A and 31B at its opposite ends.

A cylindrical head portion 31C is projected downward at and from the other longitudinal end of the link lever 31. Wrapped around and fixed to the head portion 31C is a bent portion 34A of the expansion spring 34, which will be described hereinafter. Further, a pin receptacle hole 31D is bored vertically through the link lever 31 at a longitudinally intermediate portion, and the pivoting pin 32 is passed through this pin receptacle hole 31D. Thus, through the pivoting pin 32, the link lever 31 is pivotally supported in the slot 3C of the actuator mount portion 3B.

Further, the link lever 31 is provided with a sensor mount hole 31E between the head portion 31C and the pin receptacle hole 31D, and a tilt angle sensor (not shown) is mounted in the sensor mount hole 31E. The tilt angle sensor is adapted to detect tilt angle of the swash plate 11 by detecting a turn angle of the link lever 31 by way of a testee body (not shown) which is fixed on a wall surface of the actuator mount portion 3B shown in FIG. 2 or fixed in other cooperative position.

Designated at 33 is the coupling pin, the opposite ends of which are fixed in the pin support portions 31A and 31B of the link lever 31. This coupling pin 33 is supported by the pin support portions 31A and 31B of the link lever 31 at both ends, and its axially intermediate portion is put in and connected (engaged) with the notched portion 26A on the control sleeve 26 in a radial direction.

As the link lever 31 is turned (rocked) about the pivoting pin 32, this movement of the link lever 31 is transmitted to the control sleeve 26 through and by the coupling pin 33. As a consequence, the control sleeve 26 is put in a sliding displacement within the valve case 25 of the regulator 24 in an axial direction (e.g., in the direction of axis O2-O2 shown in FIG. 6).

Indicated at 34 is the expansion spring, a spring member which constitutes the feedback link 30 together with the link lever 31. This expansion spring 34 is formed by bending a longitudinally intermediate portion of a narrow metal leaf spring into substantially U-shape, so that the expansion spring 34 has a bent portion 34A of substantially U- or C-shape on the side of its base end. On the other hand, at a fore end, the expansion spring 34 is provided with a pair of convexly curved plate portions 34B and 34C which are formed with the same radius of curvature. These convexly curved plate portions 34B and 34C are provided on fore ends of bifurcated expansion arms which are spread away from each other in a forward direction.

Further, as shown in FIG. 5, a pair of pin receptacle holes 34D (one of which is shown in the drawing) are bored at transversely opposing portions of the bent portion 34A of the expansion spring 34. After wrapping the bent portion 34A of the expansion spring 34 around the head portion 31C of the link lever 31, a stopper pin 35 is placed in the respective pin receptacle holes 34D and the head portion 31C thereby stopping rotational movements of the expansion spring 34 relative to the head portion 31C, while at the same time preventing the expansion spring 34 from coming off the head portion 31C.

On the other hand, the convexly curved plate portions 34B and 34C of the expansion spring 34 are inserted into the indented groove 21 of the servo piston 18 from the side of the tapered groove portion 21B and engaged with (interposed between) the parallel groove portion 21A of the indented groove 21 in a resiliently flexed state. An axial displacement of the servo piston 18 is transmitted to the expansion spring 34 from the parallel groove portion 21A of the indented groove 21 through the convexly curved plate portions 34B and 34C. Further, the link lever 31 which is integrally assembled with the expansion spring 34 is turned around the pivoting pin 32 following a displacement of the servo piston 18.

Namely, as the servo piston 18 is displaced in the direction of arrow A of FIGS. 7 and 8 along the axis O1-O1, the convexly curved plate portion 34B of the expansion spring 34 is pushed in the direction of arrow a by the parallel groove portion 21A (by the side wall surface 21A1) of the indented groove 21. This pushing force is transmitted to the link lever 31 from the convexly curved plate portion 34B of the expansion spring 34 through the bent portion 34A and the stopper pin 35. As a consequence, the link lever 31 is turned about the pivoting pin 32 to displace the control sleeve 26 in the direction of arrow C along the axis O2-O2.

On the other hand, as the servo piston 18 is displaced in the direction of arrow B of FIGS. 7 and 8 along the axis O1-O1, the convexly curved portion 34C of the expansion spring 34 is pushed in the direction of arrow b by the parallel groove portion 21A (by the side wall surface 21A2). This pushing force is transmitted to the link lever 31 from the convexly curved plate portion 34C of the expansion spring 34 through the bent portion 34A and the stopper pin 35. As a result, the link lever 31 is turned about the pivoting pin 32 to displace the control sleeve 26 in the direction of arrow D along the axis O2-O2.

In this instance, as shown in FIGS. 6 to 8, a reference line K-K is drawn through the center of the pivoting pin 32 and in perpendicularly intersecting relation with the longitudinal axes O1-O1 and O2-O2 of the servo piston 18 and the control sleeve 26. As the servo piston 18 is axially displaced, the feedback link 30 which is composed of the link lever 31 and the expansion spring 34 is rocked about the pivoting pin 32 toward either side of the reference line K-K following the displacement of the servo piston 18.

As a consequence, when the servo piston 18 is displaced in the direction of arrow A in FIGS. 7 and 8, the control sleeve 26 is displaced by the feedback link 30 in the direction of arrow C. In case the servo piston 18 is displaced in the direction of arrow B, the control sleeve 26 is displaced by the feedback link 30 in the direction of arrow D.

Now, turning to FIG. 9, there is shown a hydraulic circuit for controlling the displacement capacity of the hydraulic pump 1. In this figure, indicated at 36 is a pilot pump which constitutes a low-pressure oil source together with a tank 37. The pilot pump 36 takes in operating oil from the tank 37 and delivers a tilting control oil pressure (a tilting control pressure) to a control pressure conduit 38.

In this instance, by way of the regulator 24, the control pressure conduit 38 is brought into and out of communication with another control pressure conduit 39, which is connected to the pressure chamber 19A of the tilting actuator 16. By way of a low-pressure relief valve (not shown) or the like, the pressure of the pressure oil which is discharged from the pilot pump 36 is maintained at a pressure level which is low enough as compared with the discharge oil pressure of the hydraulic pump 1.

In this instance, a pilot pressure fed to the hydraulic pilot portion 29 becomes smaller than biasing force of the valve spring 28, the spool 27 of the regulator 24 is displaced to the right in FIG. 9. As a result, the regulator 24 is changed over to a switched position (F) from a neutral position (E). When the regulator 24 is changed over to the switched position (F), the pilot pump 36 is connected to the pressure chamber 19A of the tilting actuator 16 through the control pressure conduits 38 and 39 to supply a tilting control pressure from the pilot pump 36 to the pressure chamber 19A.

As soon as a pilot pressure to the hydraulic pilot portion 29 becomes larger than biasing force of the valve spring 28, the spool 27 of the regulator 24 is displaced to the left in FIG. 9. As a result, the regulator 24 is changed over to a switched position (G) from the neutral position (E). When the regulator 24 is changed over to the switched position (G), the control pressure conduit 39 is connected to the tank 37 to drain pressure oil into the tank 37 from the pressure chamber 19A of the tilting actuator 16, lowering the pressure chamber 19A to a pressure level which is almost as low as the tank pressure.

Indicated at 40 is another control pressure conduit which is branched off the above-mentioned control pressure conduit 38. At a leading end, the control pressure conduit 40 is constantly connected to the pressure chamber 19B of the tilting actuator 16. This control pressure conduit 40 serves to supply the pressure chamber 19B with a tilting control pressure from the pilot pump 36.

Indicated at 41 is a pilot conduit which is branched off the above-mentioned control pressure conduit 38. This pilot conduit 41 is provided between the hydraulic pilot portion 29 of the regulator 24 and the pilot pump 36 to connect the discharge side of the pilot pump 36 to the hydraulic pilot portion 29 through a pressure control valve 42 which will be described hereinafter.

Denoted at 42 is the pressure control valve which is provided in the course of the pilot conduit 41. This pressure control valve 42 is constituted by an electromagnetic control valve with an electromagnetic proportional solenoid 43. A pilot pressure to be supplied to the hydraulic pilot portion 29 of the regulator 24 is variably controlled by the electromagnetic proportional solenoid 43 of the pressure control valve 42.

Indicated at 44 is a discharge conduit which is provided on the discharge side of the hydraulic pump 1, and, for example, its supply/discharge passage 15 on high pressure side, shown in FIGS. 1 and 2, is connected to an external actuator (not shown). A pressure sensor (not shown) is provided in the course of the discharge conduit 44 for detection of discharge pressure of the hydraulic pump 1.

In this instance, from the pressure sensor mentioned above, the electromagnetic proportional solenoid 43 of the pressure control valve 42 is supplied with a command signal indicative of the pressure in the discharge conduit 44. On the part of the pressure control valve 42, the pilot pressure to be supplied to the hydraulic pilot portion 29 of the regulator 24 is increased or reduced according to a command signal outputted to the electromagnetic proportional solenoid 43 (e.g., a pressure variation in the discharge conduit 44).

Being arranged in the manner as described above, the displacement volume of the hydraulic pump 1 controlled by the above hydraulic circuit in the manner as follows.

In the first place, as long as command signals to the electromagnetic proportional solenoid 43 of the pressure control valve 42 remain substantially constant, the spool 27 of the regulator 24 is retained in the neutral position (E) as shown in FIG. 9, and, by the tilting actuator 16, the swash plate 11 of the hydraulic pump 1 is retained substantially at a constant tilt angle shown.

In this state, the pilot pressure to be supplied from the pressure control valve 42 is increased as soon as a command signal for increasing the tilt angle of the swash plate 11 is applied to the electromagnetic proportional solenoid 43. Thus, the pilot pressure to the hydraulic pilot portion 29 of the regulator 24 is increased by the pressure control valve 42, and the spool 27 of the regulator 24 is displaced to the left against the action of the valve spring 28. As a consequence, the regulator 24 is changed over from the neutral position (E) to the switched position (G) to connect the control pressure conduit 39 to the tank 37.

Thus, on the part of the tilting actuator 16, pressure oil in the pressure chamber 19A discharged to the side of the tank 37, while a tilting control pressure is supplied to the pressure chamber 19B from the control pressure conduit 40. As a result, the servo piston 18 is put in a sliding displacement in the direction of arrow A according to a pressure differential between the pressure chambers 19A and 19B, driving the swash plate 11 of the hydraulic pump 1 toward a larger tilt angle position.

In the meantime, the movement of the servo piston 18 is transmitted to the control sleeve 26 of the regulator 24 through the feedback link 30. As the servo piston 18 is displaced in the direction of arrow A, the feedback link 30 is displaced about the pivoting pin 32 in the direction of arrow C in FIG. 9 to put the control sleeve 26 in a sliding displacement in the same direction as the spool 27. Thus, a movement of the servo piston 8 is fed back to the regulator 24 by and through the feedback link 30.

As a tilt angle of the swash plate 11 reaches a value corresponding to a command for a larger tilt angle as applied by the above-mentioned command signal, the control sleeve 26 is displaced in the direction of arrow C to return the regulator 24 to the neutral position (E). As a consequence, the displacement volume of the hydraulic pump 1 is controlled to deliver pressure oil at a large rate corresponding to the applied command signal.

On the other hand, when a command signal is applied to the electromagnetic solenoid 43 to minimize the tilt angle of the swash plate 11, the pilot pressure is reduced by the pressure control valve 42. Therefore, the spool 27 of the regulator 24 is displaced in a rightward direction in FIG. 9. Thus, the regulator 24 is changed over to the switched position (F) from the neutral position (E) by the valve spring 28, connecting the pilot pump 36 to the pressure chamber 19A of the tilting actuator 16 through the control pressure conduits 38 and 39.

Now, a tilting control pressure from the pilot pump 36 is supplied to the pressure chambers 19A and 19B of the tilting actuator 16. As a result, the servo piston 18 is put in a sliding displacement in the direction of arrow B according to a difference in pressure receiving area between the pressure chambers 19A and 19B, driving the swash plate 11 of the hydraulic pump 1 into a smaller tilt angle position.

Further, the movement of the servo piston 18 is fed back to the control sleeve 26 of the regulator 24 through the feedback link 30. When the servo piston 18 is displaced in the direction of arrow B, the feedback link 30 is displaced about the pivoting pin 32 in the direction of arrow D in FIG. 9 to put the control sleeve 26 in a sliding displacement in the same direction as the spool 27. Thus, a movement of the servo piston 18 is fed back to the regulator 24 by and through the feedback link 30.

As soon as the tilt angle of the swash plate 11 reaches a value corresponding to a command for a smaller tilt angle as applied by the above-mentioned command signal, the control sleeve 26 is displaced in the direction of arrow D to return the regulator 24 to the neutral position (E). As a result, the displacement volume of the hydraulic pump 1 is controlled to deliver pressure oil at a smaller rate corresponding to the applied command signal.

In this instance, in following the movement of the servo piston 18 of the tilting actuator 16, the feedback link 30 operates in the manner as follows. In order to transmit movements of the servo piston 18 to the control sleeve 26 of the regulator 24, this feedback link 30 is constituted by the link lever 31 formed of a rigid material and the expansion spring 34 formed of a spring material.

When the servo piston 18 is displaced in the direction of arrow A from the position of FIG. 8 to the position shown in FIG. 7, the convexly curved plate portion 34B of the expansion spring 34 is pushed in the direction of arrow a by the parallel groove portion 21A (the side wall portion 21A1) of the indented groove 21. At this time, the pushing force is transmitted to the link lever 31 from the convexly curved plate portion 34B of the expansion spring 34 through the bent portion 34A and the stopper pin 35. Thus, the link lever 31 is rocked (turned) about the pivoting pin 32 to displace the control sleeve 26 in the direction of arrow C along the axis O2-O2.

At this time, the arcuate (convex) face of the convexly curved plate portion 34B of the expansion spring 34, which is in abutting engagement with the side wall portion 21A1 of the parallel groove portion 21A, is engaged with the latter smoothly, permitting the link lever 31 to pick up an axial displacement of the servo piston 18 from the expansion spring 34 as a pushing force in the direction of arrow a through the side wall portion 21A1 of the indented groove 21 in a stabilized manner.

In the meantime, the arcuate (convex) face of the other convexly curved plate portion 34C of the expansion spring 34 is continuously abutted against the side wall portion 21A2 of the parallel groove portion 21A. Therefore, the convexly curved plate portions 34B and 34C, formed in an arcuate shape, are resiliently abutted against the side wall portions 21A1 and 21A2 of the parallel groove portion 21A, without making rattling movements or opening up a gap space therebetween.

On the other hand, as the servo piston 18 is displaced in the direction of arrow B from the position of FIG. 7 to the position shown in FIG. 8, the convexly curved plate portion 34C of the expansion spring 34 is pushed in the direction of arrow b by parallel groove portion 21A (the side wall portion 21A2) of the indented groove 21. At this time, the pushing force is transmitted to the link lever 31 from the convexly curved plate portion 34C of the expansion spring 34 through the bent portion 34A and the stopper pin 35. Thus, the link lever 31 is rocked (turned) about the pivoting pin 32 to displace the control sleeve 26 in the direction of arrow D along the axis O2-O2.

Even in this case, the arcuate (convex) face of the convexly curved plate portion 34C of the expansion spring 34 is abutted against and smoothly engaged with the side wall portion 21A2 of the parallel groove portion 21A, permitting the link lever 31 to pick up an axial displacement of the servo piston 18 from the expansion spring 34 as a pushing force applied in the direction of arrow b through the side wall portion 21A2 of the indented groove 21.

Further, at this time, the arcuate (convex) face of the convexly curved plate portion 34B of the expansion spring 34 is continuously abutted against the side wall portion 21A1 of the parallel groove portion 21A. Therefore, both of the convexly curved plate portions 34B and 34C are resiliently abutted against the side wall portions 21A1 and 21A2 of the parallel groove portion 21A, without making rattling movements or opening up a gap space therebetween.

Thus, according to the present embodiment, the convexly curved plate portions 34B and 34C which are provided on the bifurcated arms of the expansion spring 34 of the feedback link 30 are engaged in the parallel groove portion 21A of the indented groove 21 on the servo piston 18 in a resiliently deformed state. That is to say, the arcuate faces of the convexly curved plate portions 34B and 34C are resiliently abutted against the side wall portions 21A1 and 21A2 of the parallel groove portion 21A, respectively.

Therefore, even if the direction of displacement of the servo piston 18 is frequently switched from A to B or vice versa, the convexly curved plate portions 34B and 34C of the expansion spring 34 can be continuously kept in abutting engagement with the side wall portions 21A1 and 21A2 of the parallel groove portion 21A, preventing rattling movements which might otherwise occur therebetween.

Besides, the convexly curved plate portions 34B and 34C of the expansion spring 34 are abutted against the side wall portions 21A1 and 21A2 of the indented groove 21 smoothly through the respective arcuate faces, so that the link lever 31 can pick up an axial displacement of the servo piston 18 in a stabilized manner.

Accordingly, it becomes possible to prevent rattling movements from occurring between the convexly curved plate portions 34B and 34C of the expansion spring 34 and the indented groove 21 of the servo piston 18 even in case the tilting angle (the displacement volume) of the swash plate 11 is controlled repeatedly over a long period of time. Furthermore, it becomes possible to prevent imposition of impact loads on the convexly curved plate portions 34B and 34C of the expansion spring 34 as well as plastic deformations of the expansion spring 34.

Moreover, the feedback link 30 for transmitting a movement of the servo piston 18 to the control sleeve 26 of the regulator 24 is constituted by the link lever 31 formed of a rigid material and the expansion spring 34 formed of a spring material. Therefore, high frequency vibrations from the side of the servo piston 18 are attenuated by the spring action of the expansion spring 34 to prevent repeated minute vibrations which might otherwise occur to the link lever 31 of a rigid material.

Namely, when the hydraulic pump 1 is in operation under the variable displacement control as described above, pressure pulsations can occur on the discharge side of the hydraulic pump 1. If such pressure pulsations occur when the discharge pressure of the hydraulic pump 1 is at a high level, the pulsations are transmitted as vibrations to the swash plate 11 through the respective cylinders 7 and pistons 8 of the cylinder block 6 to put the swash plate 11 in repeated high frequency vibrations at a high vibrational frequency.

Such high frequency vibrations of the swash plate 11 are transmitted to the servo piston 18 of the tilting actuator 16 through the tilting lever 12 and the slide plate 23, and further to the feedback link 30 as minute vibrations. Therefore, damages to or impairment of the feedback link 30 may occur under the influence of the high frequency vibrations.

However, according to the present embodiment, thanks to the use of the expansion spring 34, the feedback link 30 is imparted with spring action, and above-mentioned high frequency vibrations can be attenuated by the expansion spring 34, preventing direct transmission of vibrations to the link lever 31 of a rigid material to ensure enhanced durability and prolonged service life of the link lever 31.

Thus, according to the present embodiment, when the swash plate 11 is put in repeated high frequency vibrations under the influence of pulsations in oil pressure, transmitting high frequency vibrations to the servo piston 18 from the swash plate 11, such vibrations are attenuated by the expansion spring 34 (in the form of a leaf spring) which constitutes part of the feedback link 30 to preclude possibilities of damages or impairment of the feedback link 30 which might occur as a result of repetitions of minute vibrations.

Besides, even if the control of the tilt angle of the swash plate 11 is repeated over a long period of time, the convexly curved plate portions 34B and 34C of the expansion spring 34 can be engaged in the indented groove 21 on the servo piston 18 free of rattling movements against the latter, precluding possibilities of plastic deformations of the expansion spring 34. Accordingly, axial displacements of the servo piston 18 can be picked up through the feedback link 30 over an extended period of time in a stable manner, stabilizing the displacement control over the hydraulic pump 1 with higher operational reliability.

Further, the bent portion 34A at one end of the expansion spring 34 is wrapped around the head portion 31C of the link lever 31 and fixed by the stopper pin 35, while the convexly curved plate portions 34B and 34C at the other end of the expansion spring 34 are held in abutting engagement with the parallel groove portion 21A in the indented groove 21 on the servo piston 18 in a resiliently deformed state. Therefore, the use of the expansion spring 34 of the above-described arrangements make it easier to alter the mounting direction of the feedback link 30 relative to the tilting actuator 16, increasing the degree of freedom in mounting the regulator 24 or other component parts.

In the foregoing embodiments, by way of example the present invention has been applied to a swash plate type hydraulic pump as a typical example of a swash plate type variable displacement hydraulic rotary machine. However, needless to say, the present invention is not limited to the particular example shown. For instance, the present invention is similarly applicable to a swash plate type variable displacement hydraulic motor. In the case of a hydraulic motor, the paired supply/discharge passages 14 and 15 in the foregoing embodiment are a pair of passages for supplying and discharging high pressure oil.

The invention claimed is:

1. A swash plate type variable displacement hydraulic rotary machine, including a tubular casing, a rotational shaft rotatably supported within said casing, a cylinder block mounted on said rotational shaft within said casing and bored with a plural number of axially extending cylinders at radially spaced positions, a plural number of pistons reciprocally fitted in said cylinders of said cylinder block and each having a shoe at a projected end, a swash plate tiltably provided in said casing and provided with a sliding surface for sliding engagement with said shoe, a tilting actuator provided with a servo piston in said casing to drive said swash plate into a tilted position according to a supplied tilting control pressure, a regulator in the form of a servo valve provided in said casing and having a spool within a control sleeve to variably control a tilting control pressure to said tilting actuator, and a feedback link provided between said control sleeve of said regulator and said servo piston of said tilting actuator to transmit a displacement of said servo piston to said control sleeve, characterized in that:

said feedback link is constituted by a link lever having one longitudinal end thereof connected to said control sleeve of said regulator, and an expansion spring being fixed to the other end of said link lever at a base end and having two fore distal ends spread apart from each other by spring action;

an indented groove is provided on the outer peripheral side of said servo piston having side walls in abutting engagement with each of said fore distal ends of said expansion spring;

each of said fore distal ends of said expansion spring are resiliently abutted against one of the respective side walls of said side walls of said indented groove of said servo piston in a resiliently deformed state to transmit a displacement of said servo piston from said expansion spring to said link lever;

as said servo piston is displaced in a first direction, said expansion spring transmits displacement in said first direction to said link lever in such a manner that one fore distal end is pushed in said first direction by one side wall of said side walls of said indented groove and said other fore distal end abuts against said other side wall; and as said servo piston is displaced in a second direction, said expansion spring transmits displacement in said second direction to said link lever in such a manner that said other fore distal end is pushed in said second direction by said other side wall of said indented groove and said one fore distal end abuts against said one side wall.

2. A swash plate type variable displacement hydraulic rotary machine as defined in claim 1, wherein said expansion spring is formed by folding a narrow leaf spring substantially into a U-shape.

3. A swash plate type variable displacement hydraulic rotary machine as defined in claim 1, wherein a pair of convexly curved plate portions is provided on each of said fore distal ends of said expansion spring, said convexly curved plate portions having arcuate faces resiliently abutted against side wall portions of said indented groove.

4. A swash plate type variable displacement hydraulic rotary machine as defined in claim 1, wherein said indented groove on said servo piston is composed of a parallel groove portion extending transversely on said servo piston, and a tapered groove portion connected to and spread in a tapered fashion in a direction away from said parallel groove portion for guiding each of said fore distal ends of said expansion spring into said parallel groove portion.

* * * * *